United States Patent [19]

Hagan et al.

[11] Patent Number: 4,731,034

[45] Date of Patent: Mar. 15, 1988

[54] ELECTRICAL TERMINAL ASSEMBLY AND METHOD OF MAKING THE SAME

[75] Inventors: Robert A. Hagan, Roscoe; Ernest W. Reinwall, McHenry, both of Ill.

[73] Assignee: Elco Industries, Inc., Rockford, Ill.

[21] Appl. No.: 26,031

[22] Filed: Mar. 16, 1987

[51] Int. Cl.[4] ..... H01R 13/415

[52] U.S. Cl. ..... 439/891; 439/736; 29/882

[58] Field of Search ..... 439/78, 81, 82, 83, 439/84, 736, 741, 742, 743, 869, 870, 874, 876, 877; 29/877, 878, 879, 882

[56] References Cited

U.S. PATENT DOCUMENTS

| | | | |
|---|---|---|---|
| 2,006,813 | 7/1935 | Norwood | 72/105 |
| 2,329,471 | 9/1943 | King | 85/2 |
| 2,495,103 | 1/1950 | Huppert | 85/5 |
| 2,495,104 | 1/1950 | Huppert | 85/5 |
| 2,840,793 | 6/1958 | Sunko et al. | 439/741 |
| 3,538,491 | 11/1970 | Longenecker et al. | 439/876 |
| 3,562,699 | 2/1971 | Branden et al. | 439/736 |
| 3,704,173 | 11/1972 | McClelland et al. | 439/870 |
| 3,778,755 | 12/1973 | Marks | 339/220 |
| 4,114,976 | 9/1978 | Selvin et al. | 439/736 |
| 4,183,600 | 1/1980 | Schroeder | 439/736 |
| 4,614,029 | 9/1986 | Neumann et al. | 29/882 |

*Primary Examiner*—Gil Weidenfeld
*Assistant Examiner*—Gary F. Paumen
*Attorney, Agent, or Firm*—Leydig, Voit & Mayer, Ltd.

[57] ABSTRACT

The terminal assembly includes a terminal element made of yieldable material and a tubular post made of soft, flowable material. One end portion of the terminal element is defined by a slotted tube-like member adapted to telescope into the post. When the post and the tube-like member are squeezed axially together during assembly, the tube-like member collapses axially and expands radially to cause the soft material of the post to flow into and interlock with the slots and thereby establish a positive electrical and mechanical connection between the terminal element and the post.

7 Claims, 6 Drawing Figures

ELECTRICAL TERMINAL ASSEMBLY AND METHOD OF MAKING THE SAME

BACKGROUND OF THE INVENTION

This invention relates to an electrical terminal assembly and to a method of making the same. While the terminal assembly of the invention lends itself to various applications, the terminal assembly is particularly adapted for use in connection with a dry cell battery.

More specifically, the invention relates to a terminal assembly of the type which includes a tubular terminal post defining a closed-end socket and made of a soft and flowable material such as lead. A terminal element is telescoped into the socket of the post in electrical contact with the post and forms one of the output terminals of the battery.

SUMMARY OF THE INVENTION

The general aim of the present invention is to provide a terminal assembly of the above general type and having a new and improved terminal element which may be manufactured in an extremely simple manner and which may be assembled in permanent and very positive surface contact with the tubular post of the terminal assembly.

A more detailed object of the invention is to achieve the foregoing by providing a terminal element which may be manufactured by a simple blanking and forming operation and which, when assembled with the tubular post, is adapted to be expanded into intimate interlocking engagement with the soft material of the post.

The invention also resides in the unique construction of the terminal element enabling the element to expand and interlock with the material of the post. Further, the invention resides in the method of assembling the terminal element and the post.

These and other objects and advantages of the invention will become more apparent from the following detailed description when taken in conjunction with the accompanying drawings.

DETAILED DESCRIPTION OF THE PREFERRED EMBODIMENT

Figure 1:
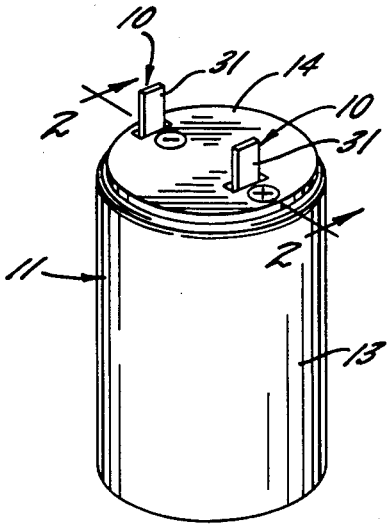
FIG. 1 is a perspective view of a typical dry cell battery equipped with new and improved terminal assemblies incorporating the unique features of the present invention.

As shown in the drawings for purposes of illustration, the invention is embodied in an electrical terminal assembly 10 which preferably but not necessarily is used in conjunction with a dry cell battery 11. As is conventional, the battery includes a positive terminal assembly and a negative terminal assembly. The two terminal assemblies herein are identical to one another and thus a description of one will suffice for both.

Briefly, the battery 11 includes an inner tubular liner 12 (FIG. 2) telescoped into a tubular sheet metal case 13 whose upper end is closed by a plastic cap 14. A plastic terminal assembly holder 15 which is generally circular in shape is telescoped into the liner 12 and is formed with the usual vent hole 16. The terminal holder 15 is spaced just above a pair of internal battery terminals 17 within the case 13.

Each terminal assembly 10 includes a tubular post 20 (FIG. 3) made of lead or other relatively soft, deformable and flowable material. The two posts are telescoped into holes 21 (FIG. 3) in the holder 15, and in the battery 11 as finally assembled, the lower ends of the posts engage and make electrical contact with the internal terminals 17.

Each tubular post 20 includes an upwardly opening and generally cylindrical socket 23 (FIG. 3) defined by an annular side wall 24 and by a closed lower end wall 25. The socket 23 is adapted to receive the lower end portion of a terminal element 30 which forms part of the overall terminal assembly 10 and which, in this particular instance, includes an upper end portion 31 defined by a flat, elongated and upwardly projecting connector prong. The prongs 31 of the two terminal assemblies 10 project upwardly through slots 32 (FIG. 2) in the cap 14 and serve as means by which the battery 11 may be connected to an electrical utilization device (not shown).

In accordance with the present invention, each terminal element 30 is uniquely constructed so that an elongated portion 35 of the terminal element collapses longitudinally and expands radially when the elongated portion 35 is pressed into telescoping relation with the socket 23 of the post 20. As an incident to the longitudinal collapse and radial expansion of the elongated portion 35 of the terminal element 30, the soft lead of the post 20 flows into interlocking engagement with the terminal element so as to effect permanent assembly and positive electrical contact between the terminal element and the tubular post of the terminal assembly 10.

More specifically, the terminal element 30 is formed from a single piece of yieldable and electrically conductive metal such as steel plated with tin and having a thickness of approximately 0.032". The vertical prong 31 of the terminal element 30 is generally rectangular and its lower end is formed integrally with the outer end of a connecting web 37 (FIG. 4) which extends horizontally and generally perpendicular to the prong.

The elongated portion 35 of the terminal element 30 is generally tubular and is generally arcuate in transverse cross-section. The tubular element 35 is offset laterally from the prong 31 and a portion of its upper end is joined integrally with the outer end of the web 37. Two transversely outwardly extending tabs 38 are formed integrally with the upper end of the tube 35 and are spaced angularly from the web 37.

Figure 4:
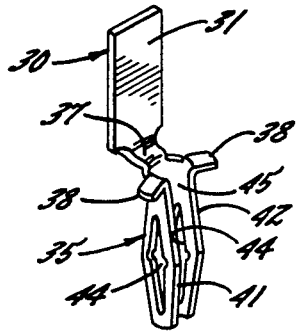
FIG. 4 is a perspective view of one of the terminal elements.

As is apparent from FIG. 4, the tube 35 extends downwardly from the web 37 or in a direction opposite to the prong 31. Like the prong, the tube 35 is generally perpendicular to the web.

Figure 3:
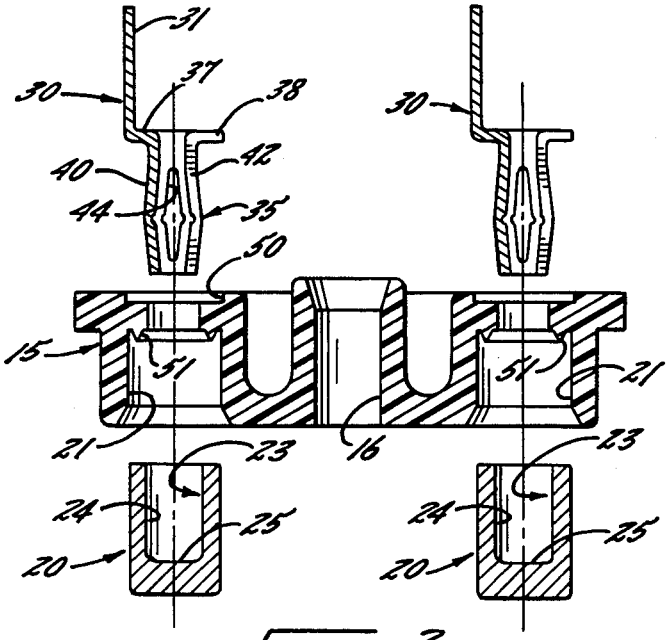
FIG. 3 is an exploded view of certain parts shown in FIG. 2.
Figure 5:
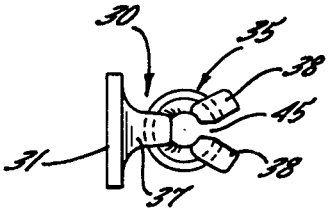
FIG. 5 is a top plan view of the terminal element shown in FIG. 4.

Pursuant to the invention, the tube 35 is formed so as to collapse axially and expand radially when endwise pressure is applied to the tube. For this purpose, the tube is formed with three angularly spaced and vertically extending legs 40, 41 and 42 (FIGS. 3 and 4). The leg 40 is continuous and extends downwardly from the inner end of the web 37. The legs 41 and 42 are located on opposite sides of the leg 40 and are separated partially from the leg 40 by slots 44 formed through the tube 35 and spaced generally diametrically from one another. As shown in FIG. 4, the slots 40 are in the form of vertically elongated "windows" whose ends terminate short of the ends of the tube 35. A third slot 45 (FIGS. 4 and 5) is located between the legs 41 and 42 and extends along the full length of the tube 35. The slot 45 is spaced generally diametrically from the leg 40.

Figure 6:
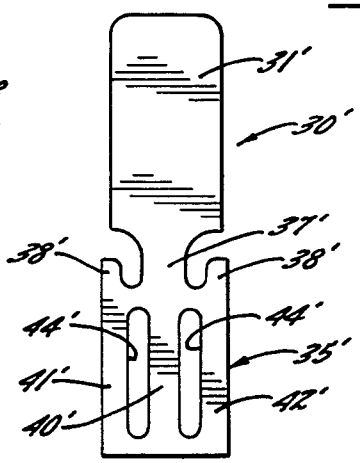
FIG. 6 is a top plan view of a sheet metal strip from which the terminal element of FIG. 4 is formed.

The terminal element 35 is formed from an initially flat and solid strip 30' of metal which, after being stamped and blanked with appropriate dies, takes on the shape shown in FIG. 6. In that view, various parts of the flat strip 30' have been designated with the same reference numerals as the corresponding part of the finished terminal element 30 but such reference numerals have been primed.

After the strip 30' has been die stamped, its lower portion is rolled to form the tube 35 and its upper portion is appropriately bent to form the prong 31, the web 37 and the tabs 38. As the tube 35 is rolled, its vertically extending edges are left in angularly spaced relation so as to form the slot 45.

During formation of the tube 35, the legs 40, 41 and 42 are purposely bowed outwardly through a slight angle as shown in FIG. 3. Thus, the tube 35 tends to flare or increase in diameter as it progresses downwardly from its upper end toward its approximate midpoint and then tapers as it progresses downwardly from its midpoint to its lower end. The slight bowing of the legs facilitates proper axial contraction and radial expansion of the tube when the terminal element 30 is subsequently assembled with the tubular post 20.

Assembly of the terminal elements 30 with the terminal holder 15 and the posts 20 is effected by inserting the posts into the holes 21 in the holder from the lower side thereof and by inserting the terminal elements into the holes from the upper side of the holder. During such assembly, the tubes 35 of the terminal elements 30 are telescoped partially into the sockets 23 of the posts 20.

Figure 2:
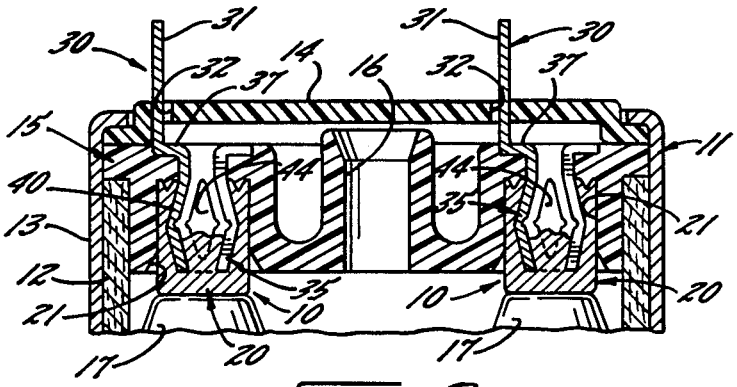
FIG. 2 is an enlarged fragmentary cross-section taken substantially along the line 2—2 of FIG. 1.

The loosely preassembled package consisting of the terminal holder 15, the posts 20 and the terminal elements 30 then is placed in a press which acts to squeeze the posts and the tubes 35 of the terminal elements toward one another with a constant load. During such squeezing, the lower ends of the tubes bottom against the closed ends 25 of the sockets 23 and, with continued pressure, the legs 40, 41 and 42 collapse axially and expand radially as shown in FIG. 2. At the same time, the posts 20 also are contracted axially to cause metal to flow radially outwardly into snug engagement with the holes 21 of the holder 15.

As the lower end of each tube 35 engages and bites into the closed end 25 of the underlying socket 23, lead from the bottom of the socket is deformed and is forced to flow upwardly into the tube (see FIG. 2). As the legs 40, 41 and 42 of the tube 35 expand outwardly, they deform the annular side wall 24 of the socket 23 and cause some of the lead of the side wall to flow into the slots 44 and 45. Such flow also is promoted by the axial compression of the post 20. The flow of lead into the tube 35 through the slots 44 and 45 and into the lower end portion of the tube causes the tube and the post 20 to become securely interlocked in intimate electrical contact. As a result, extremely good mechanical and electrical connections are established between each terminal element 30 and its associated post 20.

As pointed out above, the bowed configuration of the legs 40, 41 and 42 promotes proper collapse and expansion of the legs. In addition, opposite side edges of each slot 44 may be notched at the vertical midpoint of the slot as shown in FIGS. 3 and 4 so as to help the legs expand properly.

In the finally assembled state, the web 37 and the tabs 38 of each terminal element 30 bottom against a counterbore 50 (FIG. 3) at the upper end of the hole 21 in the holder 15. In addition, an annular rib 51 within each hole bites into the upper end of the post 20 when the parts are pressed together.

From the foregoing, it will be apparent that the present invention brings to the art a new and improved electrical terminal assembly 10 in which the tube 35 of the terminal element 30 is constructed to cause the softer lead of the post 20 to flow into and interlock with the tube. Such interlocking creates a very effective connection between the terminal element and the post.

We claim:

1. An electrical terminal assembly comprising a tubular post made of deformable and flowable conductive material and further comprising an electrical terminal made of a single piece of yieldable conductive material, said post defining a socket having an open end and an opposite closed end, said terminal comprising an elongated connector prong extending away from the open end of said socket, an elongated tubular element formed integrally with said prong, said tubular element being telescoped into said socket and having first and second ends, the first end of said tubular element being located in engagement with the closed end of the socket, said first end of said tubular element being open and receiving some of the flowable material at the closed end of said socket to help captivate said tubular element in said socket, said tubular element being generally arcuate in transverse cross-section, angularly spaced and longitudinally extending slots formed throught said tubular element, some of said flowable material extending through said slots and into said tubular element and coacting with the flowable material in said first end of said tubular element to lock said tubular element tightly in said socket.

2. An electrical terminal assembly as defined in claim 1 in which one of said slots extends the full length of said tubular element while another of said slots terminates short of the ends of said tubular element.

3. An electrical terminal assembly as defined in claim 2 further including a pair of angularly spaced tabs formed integrally with and extending transversely outwardly from said tubular element adjacent the second end thereof.

4. An electrical terminal assembly as defined in claim 3 in which said tabs are located closely adjacent the edges of said one slot.

5. An electrical terminal assembly comprising a tubular post made of deformable and flowable conductive material and further comprising an electrical terminal made of a single piece of yieldable conductive material, said post defining a socket having an open end and an opposite closed end, said terminal comprising a web located outside of said socket adjacent the open end thereof and extending generally transversely of said socket, said web having inner and outer ends, an elongated connector prong formed integrally with and disposed generally perpendicular to said web and extending from the outer end of the web in a direction leading away from the open end of said socket, an elongated tubular element formed integrally with and disposed generally perpendicular to said web and extending from the inner end of the web in a direction opposite to said prong, said tubular element being telescoped into said socket and having one end located in engagement with the closed end of the socket, said one end of said tubular element being open and receiving some of the flowable material at the closed end of said socket to help captivate said tubular element in said socket, said tubular element being generally arcuate in transverse cross-section and having an end adjacent said web, three angularly spaced and longitudinally extending slots formed through said tubular element, two of said slots being spaced generally diametrically from one another and having ends which terminate short of the ends of said tubular element, the third slot being located between said two slots, being spaced generally diametrically from said web and extending the full length of said tubular element, some of said flowable material extending through said slots and into said tubular element and coacting with the flowable material in said one end of said tubular element to lock said tubular element tightly in said socket.

6. An electrical terminal assembly as defined in claim 5 in which said tubular element flares upon progressing away from the end thereof adjacent said web and then, about midway between the ends of said tubular element, tapers upon progressing toward said one end of said tubular element.

7. A method of making an electrical terminal assembly, said method comprising the steps of:

(A) providing a tubular part made of deformable and flowable conductive material, said post defining a socket having an open end and an opposite closed end;

(B) providing an electrical terminal made of yieldable conductive material, said terminal comprising a connector portion and further comprising a tubular element having a first end joined to said connector portion and having a second and opposite end, the second end of said tubular element being open;

said tubular element having angularly spaced and longitudinally extending slots formed therethrough whereby said tubular element includes angularly spaced and longitudinally extending legs located between said slots, said legs collapsing longitudinally and expanding radially when longitudinal pressure is applied to said legs;

(C) telescoping said tubular element into said socket with the second end of said tubular element located adjacent the closed end of said socket; and (D) pressing said tubular element and said socket longitudinally together with sufficient force (1) to cause said legs to collapse longitudinally and expand radially and (2) to cause said deformable material to flow into said slots and into the second end of said tubular element thereby to lock said tubular element within said socket.

* * * * *